United States Patent [19]

Lewis et al.

[11] 4,072,108

[45] Feb. 7, 1978

[54] FUZE ENCODER DEVICE

[75] Inventors: William Lewis, Andover, Mass.; Peter J. Weldon, Blairstown; Henry Hagedorn, Jr., North Haledon, both of N.J.; Thomas E. Hayes, Newton, N.J.; Sylvan H. Israels, Morris Plains, N.J.

[73] Assignee: The United States of America as represented by the Secretary of the Army, Washington, D.C.

[21] Appl. No.: 730,402

[22] Filed: Oct. 7, 1976

[51] Int. Cl.[2] ..... F42C 11/06; F42C 17/00

[52] U.S. Cl. ..... 102/70.2 R; 89/6

[58] Field of Search ..... 102/70.2 R; 89/6

[56] References Cited

U.S. PATENT DOCUMENTS 3,667,392 6/1972 Grantham et al. ..... 102/70.2 R

*Primary Examiner*—Charles T. Jodan

*Attorney, Agent, or Firm*—Nathan Edelberg; A. Victor Erkkila; Max Yarmovsky

[57] ABSTRACT

A fuze setting device utilizes a plurality of detented, rotatable, magnet positioning time setting rings and an encoding disc for controlling the amount of electrical pulses that a timing oscillator is required to subsequently generate to fill an "and" gate controlled multistage counter. The counter after being filled generates a fuze initiating signal. A setback detented electromagnetic pulse generating despin operated sensor assembly is used in combination with the oscillator to generate electrical pulses for partially filling the counters in accordance with the relative angular positioning between the magnetic source setting rings and the pole pieces of electrical coils which generate a stop pulse to regulate the number of pulses necessary to fill the counters.

7 Claims, 8 Drawing Figures

FUZE ENCODER DEVICE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to encode electronic fuzes so that they could safe, arm and initiate the detonator of a missile or projectile a specified time after firing. One of the problems with prior art encoders was that they were frequently unable to withstand 30,000g's setback force and perform under spin rates ranging from 1500 rpm to 30,000 rpm. Another problem often encountered with prior art encoder devices was that they were not sufficiently reliable in their operation to meet the safety standard of probability of early firing of less than one in one million. In addition previous encoder devices were generally not easily capable of being set by field personnel wearing arctic gloves operating under adverse field environmental conditions while at the same time sealing the interior mechanism from the external environments.

SUMMARY OF THE INVENTION

The present invention relates to a fuze encoder device including a setting mechanism which uses magnetic supporting setting rings and an electro-magnetic sensor as a source of pulses for setting the electronic circuitry of the fuze so that it will deliver a selectable initiating fuzing signal after a desired time period. The present invention utilizes the setback and spin forces of the projectile to safe, arm and initiate the fuze.

An object of the present invention is to provide a fuze encoding device for spin stabilized ammunition application which can withstand 30,000g's setback.

Another object of the present invention is to provide a fuze encoding device for spin stabilized ammunition which can withstand 30,000g's setback force and satisfactorily operate under spin rates ranging from 1,500 rpm to 30,000 rpm.

Another object of the present invention is to provide a fuze encoding device for a spin stabilized ammunition which insures the probability of early firing is less than one in one million.

A further object of the present invention is to provide a fuze encoder device which can easily by set under adverse field conditions by field personnel wearing arctic type gloves. The present invention is designed to facilitate operation of the encoder by personnel operating in arctic environments by using a thumb size push button to unlock detents of finger size time setting rings having index marks and numerals which are widely spaced to facilitate easy and accurate setting.

A key element of the present invention is that it provides a serial setting as opposed to parallel setting normally used. This provides very significant simplification of internal wiring.

The utilization of the magnetically generated pulse technique herein described allows provision of the required setting value through a metallic structure providing a heretofore unattainable degree of environmental immunity.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
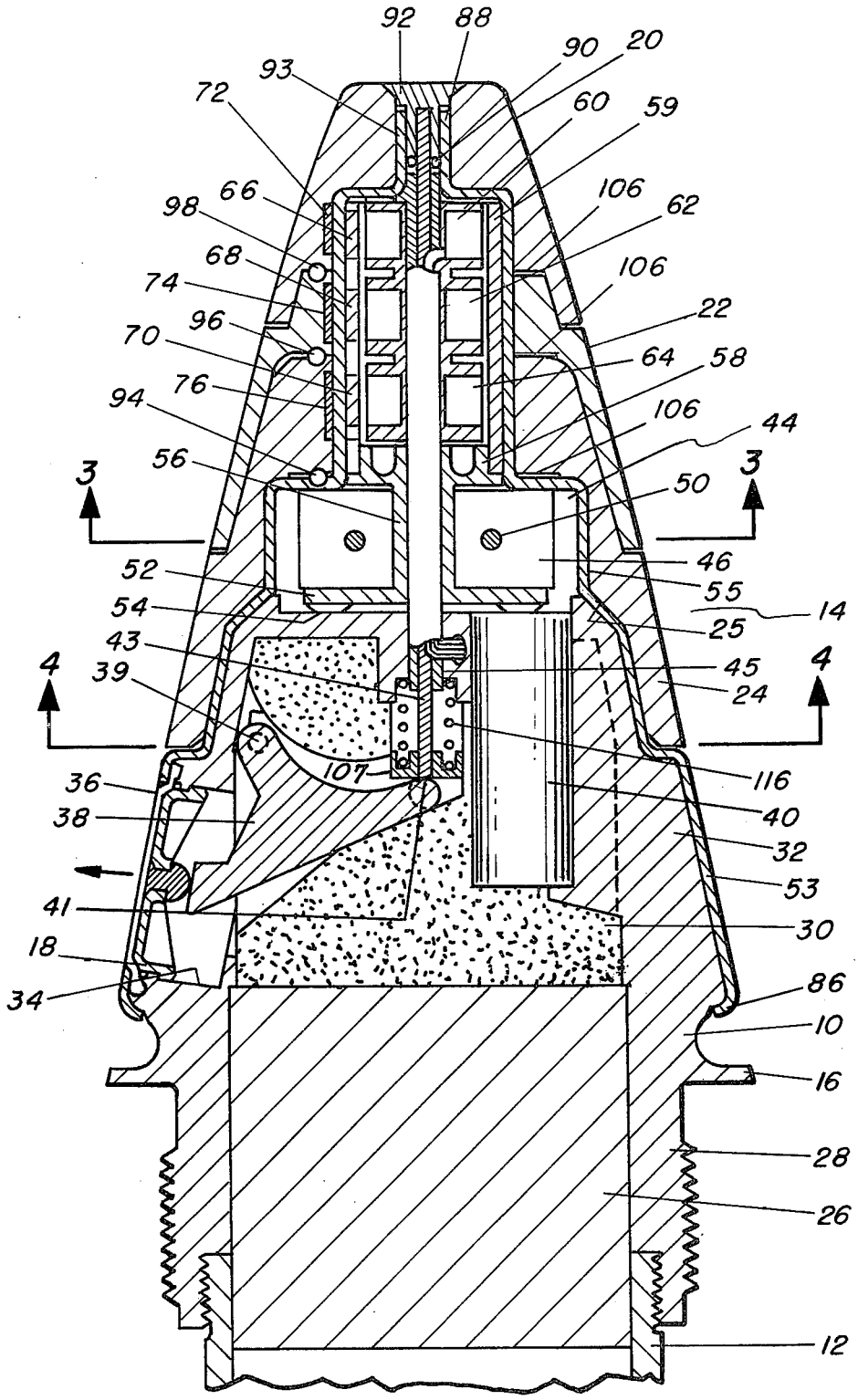
FIG. 1 is a diametral longitudinal cross-sectional view, taken along line 1—1 of FIG. 4, of the fuze encoder device disposed on the ogive end of a spin stabilized projectile showing the setting device in a locked position.
Figure 4:
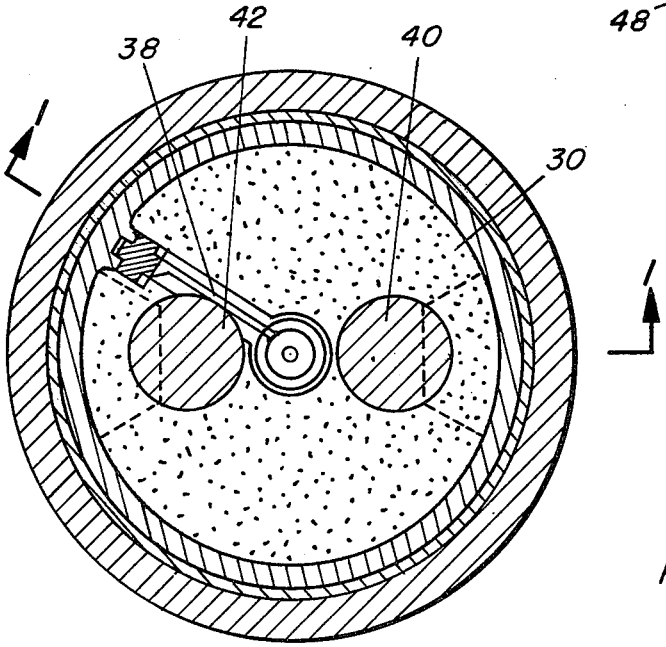
FIG. 4 is a cross-sectional view taken along line 4—4 of FIG. 1.
Figure 8:
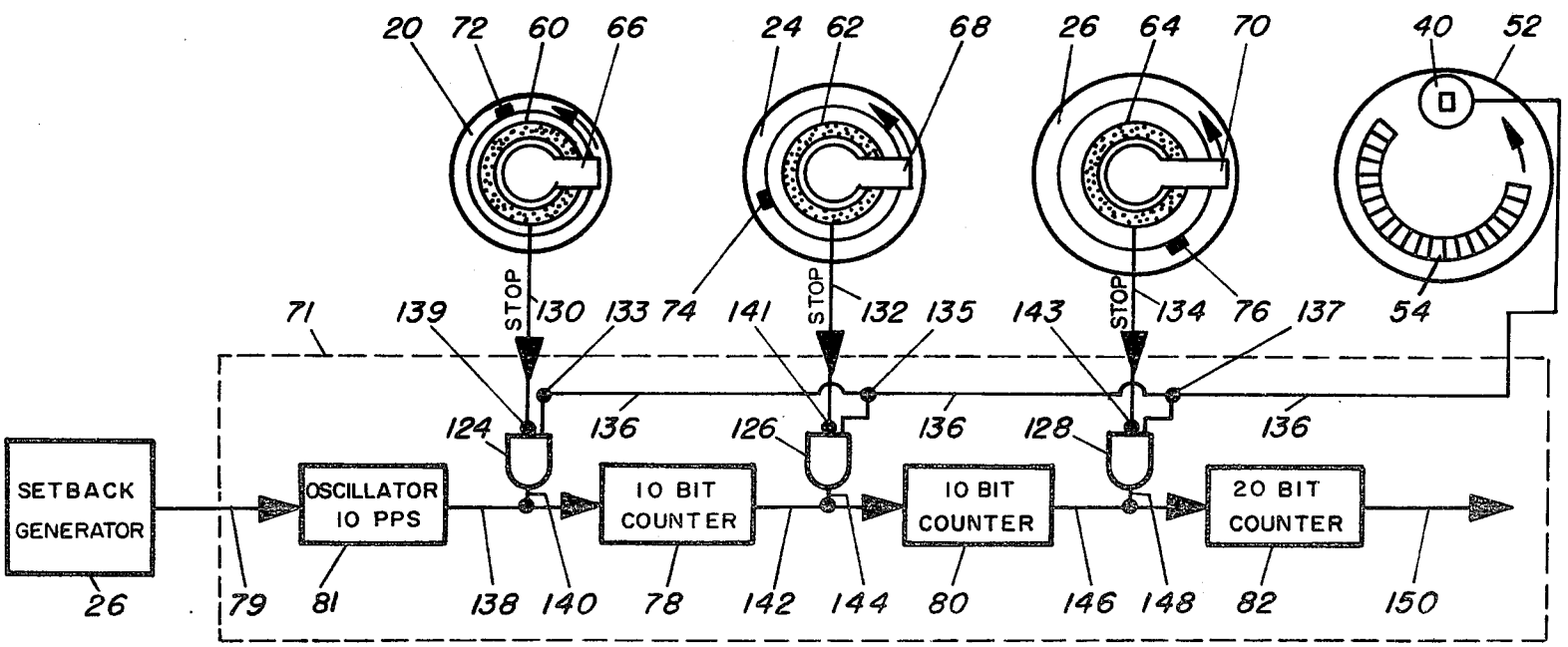
FIG. 8 is a block diagram of the fuze setting and timing functions.

Referring now to FIG. 1, a cup shaped intrusion section 10 of shell body 12 supports of fuze setting assembly 14 having an external shape which conforms to a standard ogive contour. The contour area forward of intrusion section shoulder 16 is utilized for setting purposes. A lock button 18 and cup shaped, nesting, forward, middle and aft setting rings 20, 22 and 24 respectively are utilized by field personnel to set the time for determining when a fuzing signal will be generated. When the lock button 18 is depressed, the detented setting rings 20, 22 and 24 may be rotated to a desired setting as indicated by numerals (not shown) on the ogive surfaces of the rings which line up with a stationary indexing mark 19. The lock button 18 is approximately $\frac{3}{4}$ inch in diameter and the width of setting rings 20, 22 and 24 are approximately 1, $\frac{7}{8}$ and $\frac{3}{4}$ inch respectively. These dimensions have been selected to facilitate setting of the fuze with arctic gloves and to allow for large, easy-to-read numerals to be marked thereon. A setback power generator 26 is disposed in the rear end 28 of intrusion section 10. The electronic circuitry area 30 for the fuze is located in the forward end 32 of the intrusion section 10. Referring now to FIGS. 1 and 4 lock button 18 is slidably positioned in button bore 34 located in the forward end 32 of the intrusion section 10 and peripherally hermetically sealed within button bore 34 by lock button seal 36. A biased rotatably supported flat shaped button-detent release link 38 consumes only a small portion of the total volume allocated to the electronic circuitry area 30. Link 38 is rotatably supported on pivot 39 and contacts lower end 41 of lock shaft 43 which is slidably positioned in the tubular member 45. Pivot 39 is fixedly held by intrusion section 10. Redundant encoding sensors 40, 42 are also contained in the electronics circuitry area 30. Referring now to FIGS. 1-3, 5 and 6 a despin assembly 44 includes a pair of despin weights 46 and 48 which are slidably supported on a pair of parallel positioned rod shaped despin guides 50 which are fixedly held in a stepped cup 53. An encoding disc member 52 has a plurality of projecting ferrous teeth 54 circularly disposed on a lower surface thereof. A central tubular post member 56 is axially disposed intermediate an integral rotor support flange member 58 and the integral encoding disc member 52. A first, second and third stop coil 60, 62, and 64 respectively electrical winding is axially positioned within rings 20, 22 and 24. First, second and third pole pieces 66, 68, and 70 are, magnetically and fixedly coupled to coils 60, 62, and 64 respectively and are fixedly attached to the upper surface of rotor support flange 58 by rotor member 59. Encoding disc 52 is attached to each spin weight by a pair of tether springs 49 which are each fixedly attached to tubular post 56. Transportation shock or other environments that might tend to deflect one of the weights in a radial direction also act on the opposing weights 46 and 48, and the tendency to deflect is therefore ruled out. The tether springs 49, are spirally preformed to biasedly hold the weights 46 and 48 together so that low spin rates will not be sufficient to centrifugally force the weights to move outward radially. The stop coils 60, 62 and 64 in conjunction with the pole pieces 66, 68 and 70 respectively, are proximately disposed adjacent to the localized magnetic fields of magnet members 72, 74 and 76. Magnet members 72, 74 and 76 are located in first, second and third magnet slots 73, 75 and 77 in the rotor cavities of the forward, mid and aft setting rings 20, 22 and 24 respectively. The rotational position of these magnets determines the number of pulses applied to the 10, 10 and 20 bit electronic counters 78, 80 and 82 respectively, shown in FIG. 8, and the resultant counter setting to be discussed in further detail hereinafter, when the pole pieces 66, 68 and 70 and the coding disc 52 rotate with respect to magnets 72, 74 and 76. The electronic circuitry area 30, shown in FIGS. 1 and 8, and the despin mechanism 44 are completely enclosed in stepped cup 53 which provides the primary environmental seal for these areas. The openings in cup 53 near the intrusion section shoulder 16 is sealed by the cup crimped section 86, at the lock button 18 by diaphragm seal 36, and at the forward cup end 88 by an O-ring 90 located in plug member 92. Plug member 92 is fixedly attached to forward ring 20 in forward ring axial plug bore 93 and to the forward end of lock shaft 43. At the interface between the stepped cup 53 and the aft setting ring 24, between the aft ring 24 and the middle setting ring 22, and between the middle setting ring 22 and the forward setting ring 20 are three detent assemblies 94, 96 and 98 respectively. These three detent assemblies 94, 96 and 98 prevent the inadvertent rotation of setting rings 20, 22 and 24 when the lock button 18 is not depressed, and provide clicking action to facilitate time settings when the lock button 18 is depressed. The lower surfaces of the nylon balls 108 engage a plurality of hemispherically detented seals 109 in the middle and aft sealing rings 20 and 22 and hemispherical seats 111 in the stepped cup 53. The upper surfaces of the nylon balls 108 engage seats 113 in the forward, middle and aft rings shoulders 115, 123 and 125 respectively disposed in forward, middle and aft axially positioned conical ring cavities 127, 129 and 131 respectively. There are twenty such hemispherical indexing detent ball seats 109 circularly disposed and axially aligned on the front ends of the middle and aft setting rings 22, 24 respectively, and in the forward end 55 of stepped cup 53 twenty matching hemispherically shaped detent ball seats 111.

Figure 2:
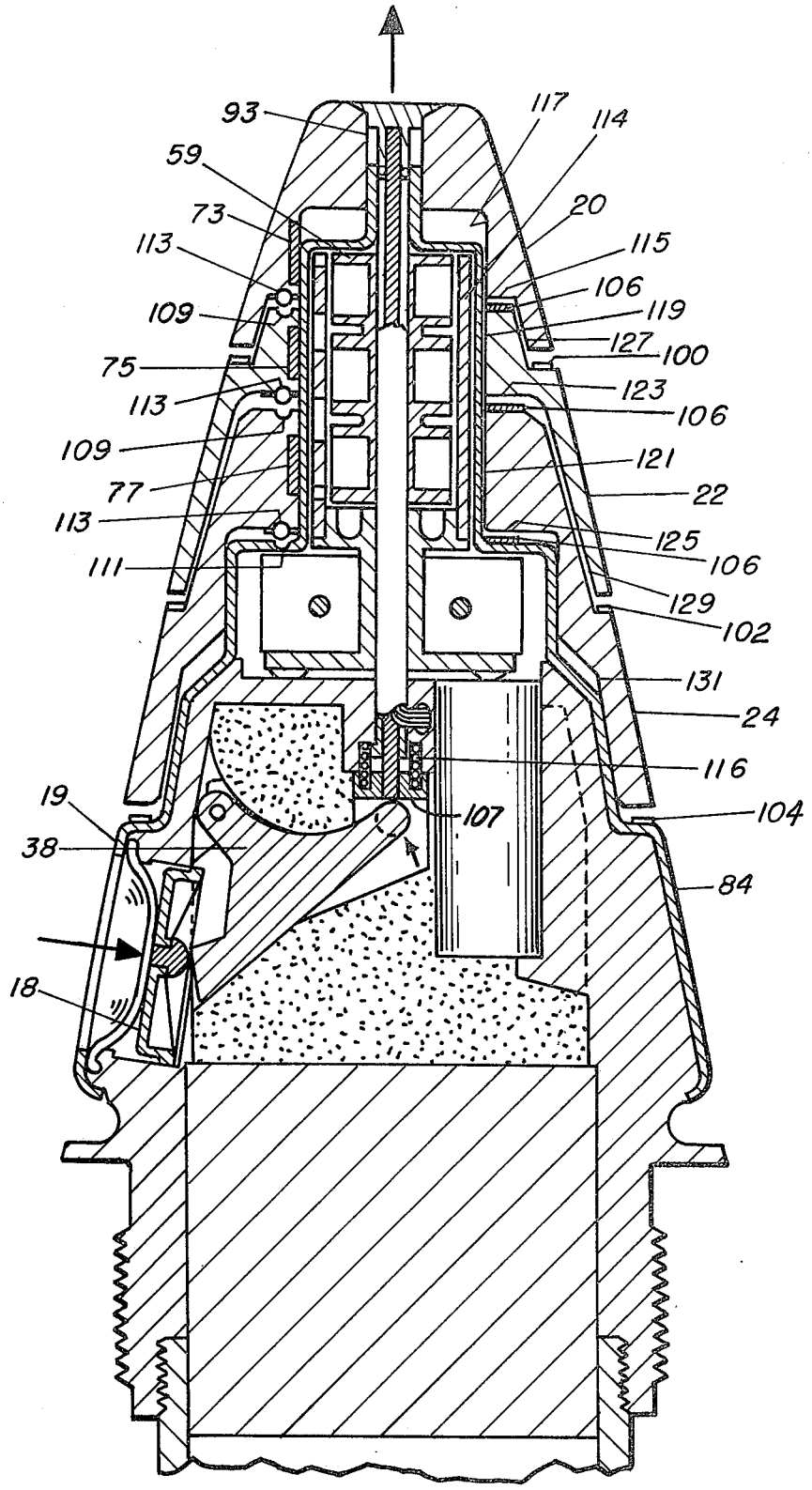
FIG. 2 is a diametral longitudinal cross-sectional view, taken along line 1—1 of FIG. 4, of the fuze encoder device in an unlocked position.
Figure 3:
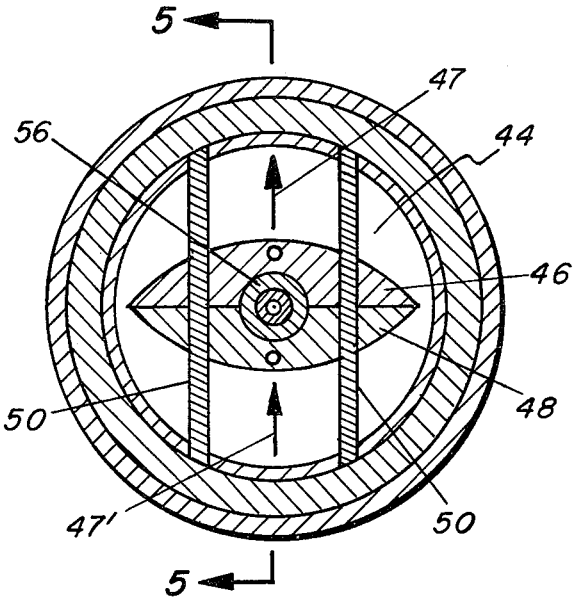
FIG. 3 is a cross-sectional view taken along line 3—3 of FIG. 1.
Figure 5:
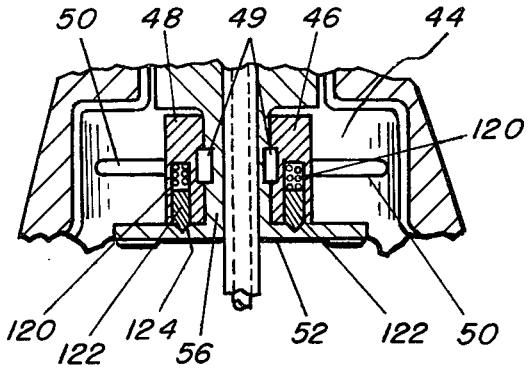
FIG. 5 is a cross-sectional view taken along line 5—5 of FIG. 3.
Figure 6:
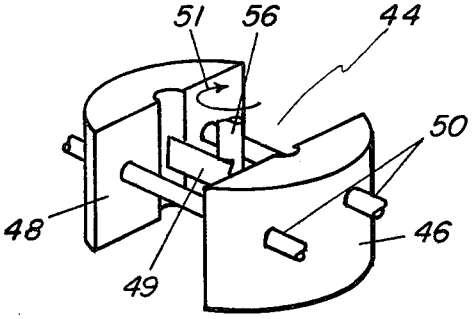
FIG. 6 is an isometric partial cutaway view of the despin assembly.
Figure 7:
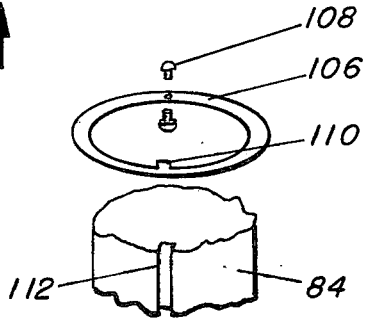
FIG. 7 is an isometric partial view of the setting rings detent devices.

Referring now to FIGS. 1, 2 and 7, the three setting rings 20, 22 and 24 utilize teflon coated plastic material to resist icing. When the lock button 18 is depressed, the three setting rings 20, 22 and 24 separate and remove pressure from "O-rings" 100, 102, and 104, located intermediate the forward ring 20 and the middle ring 22, the middle ring 22 and the aft ring 24, and the aft ring 24 and the stepped cup 53. The detent assemblies 94, 96 and 98 comprises annularly shaped wave washers 106 each containing a captured nylon ball 108 therein and having an inwardly protruding key 110 thereon which engages a keyway 112 longitudinally located in the forward section 114 of stepped cup 53 opposite each key 110.

In operation, as previously stated while the fuze is in storage, the fuze setting is locked in place by the three detent devices 94, 96 and 98. When the lock button 18 is not depressed, the partially compressed lock spring 116 maintains tension on the lock shaft 43 through spring plate 107 which is fixed thereto. Lock shaft 43 forces the three setting rings 20, 22 and 24 in an aft direction so that they tightly nest one within the other. When the encoder device is in the locked position, the aft ring 24 inner surface 25 nests on top of the stepped cup. As a result, the setting rings are locked in place by the nylon detent balls 108. When the lock button is depressed, as shown in FIG. 2, the helically shaped lock spring 116 is forced into compression by detent release link 38 which removes tension from the lock shaft 43 and permits axially positioned cylindrical first, second and third ring rotor cavities 117, 119 and 121 respectively of rings 20, 22 and 24 respectively to slide on cylindrically shaped rotor member 59 and provide separation between each of the three setting rings 20, 22 and 24. The detent devices 94, 96 and 98 maintain a spring load between adjacent setting rings. The desired time setting is accomplished by depressing the lock button 38 and rotating the setting rings 20, 22 and 24 until the actual time desired lines up with an index mark 19 disposed on stepped cup 53 surface forward of the stop button 18. The nylon balls 108, captured in the detent devices 94, 96 and 98, provide a positive click at each selectable increment. When the stop button 18 is released, as shown in FIG. 1, the lock spring 116 forces the setting rings 20, 22 and 24 to return to the aft position by again applying tension to the lock shaft 43. Positive positioning of the setting rings is maintained by the nylon balls 108 when they are in the aft position. Upon firing, the tendency for the despin weights 46 and 48 to move radially is counteracted by setback forces which secure the weights 46 and 48 in the encoding disc 52. Upon diminuation of setback forces, the centrifugal forces generated by spin of the projectile causes the weights 46 and 48 to move in a radial direction along despin guides 50 overcoming the force of a pair of detent springs 120, one being located in each weight, allowing detent pins 122 to move out of detent slots 124 located in the upper surface of encoding disc 52. As the weights 46 and 48 move outward, as indicated by direction arrows 47, 47', they apply tension to tether springs 49 which in turn apply torque in the direction indicated by arrow 51 to the encoding disc assembly through tubular post 56, stopping it, and thus inducing relative spin between the encoding disc 52 and the encoding sensors 40, 42. As the encoding disc projecting teeth 54 move past the encoding sensors 40, 42, each tooth causes a voltage pulse to be generated in the sensor 40 as a result of a change in a flux path. Attached to the encoding disc 52 are the three pole pieces 66, 68 and 70. Depending upon the position of the setting rings 20, 22 and 24, the three magnets 72, 74 and 76 attached thereto respectively provide discrete flux fields through the seal afforded by the enclosing stepped cup 53 which is sealed to the intrusion section 10. While the encoding disc assembly is rotating, the passage of the pole pieces 66, 68 and 70 past the magnets 72, 74 and 76 respectively cause a flux change which induces a current pulse in the adjacent stop coils 60, 62 and 64 respectively. These pulses generated by stop coils 60, 62 and 64 are electrically coupled to first, second and third "And" gates second output terminals 139, 141 and 143, respectively, through electrical conductors 130, 132 and 134 respectively. The stop signal pulses detected by "And" gates 124, 126 and 128 stops the flow of pulses via lead 136 from encoding sensor 40 to "And" gates 124, 126 and 128 that are being generated by ferrous teeth 54. One revolution of the encoding disc assembly is sufficient to provide the settings for all three counter stages. The arrangement of the setting rings 20, 22 and 24 in the preferred embodiment provides the most significant digit to be aft and set first, and the less significant digits to be forward. The capacity of the aft most significant digit set by ring 24 is 0–20 units, the capacity for the intermediate ring 22 is 0–10 units, and the capacity for the forward ring sets is 0–10 units. The first stop coil 60 controls the first tens counter 78, the least significant count. The second stop coil 62 controls the second tens counter 80 which is more significant by a factor of 10. The third stop coil 64 controls the twenty counter 82 which is the most significant. The total counter capacity is 2000 and the resulting time capacity is 200 seconds using an oscillator frequency of 10 counts per second. The resultant is a total capacity of 200 seconds in 0.1 increments and allows the sensor 40 to set all three counterstages in one revolution of the encoding disc 52. The electronic counter assembly enclosed in dashed box 71 shown in FIG. 8 block diagram includes 3 series connected counters 78, 80 and 82, "And" gates 124, 126 and 128, and oscillator 81 powered by the setback generator 26 through input lead 79. The outputs of oscillator 81 and first "And" gate 124 are electrically coupled to the input of 10 bit counter 78 via electrical leads 138 and 140 respectively. The outputs of the first 10 counter 78 and second "And" gate 126 are electrically coupled to the input of the second 10 bit counter 80 via electrical leads 142 and 144 respectively. The outputs of 20 bit counter 80 and the third "And" gate 128 are electrically coupled to the input of 20 bit counter 82 which when full generates an output fuzing signal via lead 150. The pulses to the counters 78, 80 and 82 may come from (1) the encoding disc 52, which sets the 3 stages in parallel and (2) from the oscillator 81.

The pulses supplied by encoding disc 52 during setting reduce the time before fuzing, since they subtract from the number of pulses the oscillator 81 must deliver to overflow counters 78, 80 and 82. The maximum time capacity occurs when no pulses are inserted by the setting mechanism, in which case the 10 PPS oscillator would require 200 seconds to deliver 200 pulses to the counters, causing overflow, and a fuzing signal, as an example, if a fuzing time of 93.4 seconds is desired. Since the oscillator provides 10 PPS, the count left in the counter, after setting, should be 934 pulses or bits. Therefore, the setting sequence would insert the equivalent of 1066 bits (200 minus 934) into the counter. To accomplish this the 20 bit counterstage 82 would receive 11 setting pulses from the coding disc 52 before the stop signal terminates setting of that stage. This leaves a balance of 9 bits, or a 900 count, as seen from the timing oscillator 81, or 90 seconds real time in the 20 bit counter. Following the same logic, the adjacent 10 bit counter 80 would receive 7 setting pulses from the encoding disc 52 before it received a stop signal from second "And" gate 126 output. This leaves a balance of 3 bits, or a 30 count as seen from the timing oscillator 81 or a 3 second real time in the middle 10 bit counter 80. Finally, the first 10 bit counter 78 would receive 6 setting pulses, leaving a balance of 4 bits, or a 4 count as seen from the timing oscillator 81 or 0.4 seconds real time. The total time to fuzing, therefore is 900 + 3 + 4 pulses, divided by 10, (due to the 10 PPS oscillator) or 93.4 seconds.

The setting sequence is implemented upon launch when the encoding disc 52 and the 3 pole pieces 66, 68 and 70 rotate in unison. The encoding disc 52 begins issuing pulses for supplying the setting to the counters via lead 136 through first input terminals 133, 135 and 137 of "And" gates 124, 126 and 128 respectively. As mentioned above, the setting simply involves pre-pulsing the 10, 10 and 20 bit counters 78, 80 and 82 respectively in parallel, reducing the number of pulses that the oscillator 81 must deliver before a fuzing signal is delivered to counter 82 output lead 150. The number of setting pulses delivered to each of the three counters is limited by a stop signal from stop coils 60, 62 and 64, which are in turn controlled by the position of magnets 72, 74 and 76, located on the setting rings 20, 22 and 24 respectively. The position desired is selected manually prior to launch. Only 20 teeth are required on the coding disc 52 to supply the required number of pulses for all three counterstages. This small number of teeth allows for wide teeth, wide gaps between teeth, and provides excellent resolution and permits commercially available sensors 40, 42 to be used. The present device shown in FIGS. 1 and 2 contain a complete dual channel system, redundant counters, oscillators, stop coils and sensors.

The three counters 78, 80 and 82 are set concurrently in parallel by the encoding disc 52. The timing function, controlled by the oscillator drives the counters in series. This allows only 20 total pulses from the encoding disc 52 to set a time to 200 seconds, in 0.1 second increments, or 2000 selectable increments. At a time during setting when no stop signals have yet been issued, one pulse from the encoding disc 52 is acutally pre-pulsing each of the 3 counters 78, 80 and 82 concurrently.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. A fuze encoder device for a spin stabilized shell which comprises:

shell housing means for supporting said encoder device which includes;

a cup shaped intrusion section, having a forward end and a rear end, threadedly supported on said shell housing means;

a stepped shaped cup stakedly disposed on and sealed to the forward end of said intrusion section, said stepped cup having a shoulder section having a plurality of circularly disposed hemispherically shaped lower detent ball seats therein;

a setback generator positioned in said aft end of said shell housing means for providing electrical energy for said encoder device;

electronic counting means, disposed in said forward end of said intrusion section, for generating an output fuzing signal;

a magnetic encoding sensor, positioned in said forward end of said intrusion section, being electrically coupled to said electronic counting means for generating pulses for setting said electronic counting means;

encoding disc means, rotatably disposed in said forward end of said stepped shaped cup and adjacent to said magnetic encoding sensor, for inducing voltage pulses in said magnetic encoding sensor;

setback detented despin weight means biasedly coupled to said encoding disc for providing relative rotation of said encoding disc means with respect to said magnetic encoding sensor when the setback forces of launch of said spin stabilized shell decrease;

indexing ring means, rotatably detented and slidably disposed on said shell housing means, for forming an ogive contour for said spin stabilized shell and for indicating a time for firing said shell, and for rotatably positioning a plurality of localized magnetic fields therein;

stop coil-pole means fixedly attached to rotate in unison with said encoding disc means and rotatably axially supported within said indexing ring means in the forward end of said intrusion section, for generating a plurality of stop pulse signals, in response to the passage of said coil-pole means in the proximity of said localized magnetic fields said plurality of stop pulse signals controlling said electronic counting means to initiate said output fuzing signal as a function of time set by said indexing ring means; and lock button detent release means, operatively disposed in said shell housing means, for releasing said indexing ring means to permit rotation therebetween to change the time set for firing said shell after launch and for preventing inadvertent movement of said indexing ring means.

2. A fuze encoder device as recited in claim 1 wherein said encoding disc means comprises:

a central tubular post member;

an encoding disc member, axially fixedly attached to one end of said tubular post member, having a plurality of projecting ferrous teeth circularly disposed on a lower surface of said encoding disc member, and a pair of detent slots located in the upper surface of said encoding disc member;

a rotor support flange axially fixedly attached to the other end of said tubular post member; and a rotor member fixedly, axially attached to said rotor support flange.

3. A fuze encoder device as recited in claim 2 wherein said setback detented despin weight means comprises:

a pair of parallel positioned, rod shaped despin guides;

a pair of despin weights biasedly slidably disposed on said pair of rod shaped despin guides;

a pair of tether springs each being fixedly attached on one end to one of said pair of despin weights, and the other end being fixedly diametrically attached to said central tubular post member; and a pair of biased detent pins operatively positioned in said pair of despin weights, said detent pins holding said weights fixedly against said encoding disc member during setback conditions and releasing said despin weights to permit movement in a radial direction when said setback condition diminishes.

4. A fuze encoder device as recited in claim 3 wherein said indexing ring means comprises:

a forward cup shaped setting ring having an axial plug bore disposed in a front end thereof, an axial first rotor cavity having a first magnet slot therein, said first rotor cavity communicating with said axial plug bore, and an axially aligned forward ring cavity communicating with said first rotor cavity, said forward ring cavity having a plurality of circularly disposed hemispherically shaped upper detent ball seats axially located in a shoulder section of said forward ring cavity;

a first magnet member fixedly located in said first magnet slot;

a plug member fixedly positioned in said axial plug bore of said forward setting ring being fixedly attached to said lock button detent means;

a middle cup shaped setting ring having a second axially aligned rotor cavity therein, said second rotor cavity having a second magnet slot therein, an axially aligned middle ring cavity communicating with said second rotor cavity and having a plurality of circularly disposed hemispherically shaped upper detent ball seats axially located in a shoulder section of said middle ring cavity, and a plurality of hemispherically shaped lower detent ball seats located in a front end of said middle cup shaped setting ring in alignment with said plurality of upper detent ball seats of said forward setting ring, said front end of said middle ring rotatably and slidably nesting into said forward ring cavity of said forward setting ring;

a second magnet member fixedly located in said second magnet slot;

an aft cup shaped setting ring having a third axially aligned cylindrically shaped rotor cavity therein, said third rotor cavity having a third magnet slot therein, an axially aligned aft ring cavity communicating with said third rotor cavity and having a plurality of circularly disposed hemispherically shaped upper detent ball seats axially located in a shoulder section of said aft ring cavity, and having a plurality of circularly disposed hemispherically shaped lower detent ball seats located in a front end of said aft setting ring in alignment with said plurality of upper detent ball seats of said middle setting ring, said front end of said aft ring rotatably and slidably nesting into said middle ring cavity of said middle setting ring, said aft ring cavity rotatably nesting upon said stepped shaped cup; and a third magnet member fixedly located in said third magnet slot.

5. A fuze encoder device as recited in claim 4 wherein said lock button detent release means comprises:

an environmentally sealed lock button operatively disposed in a button bore located in said forward end of said intrusion section;

a biased detent release link, pivotally supported by said intrusion section, having one end which slidably contacts said lock button;

a slidable axially positioned lock shaft having one end which contacts the other end of said detent release link and another end being fixedly attached to said plug member;

a spring plate fixedly attached to said other end of said lock shaft;

a helical biased spring disposed intermediate said intrusion section and said spring plate maintains tension on said lock shaft and forces said forward, middle and aft setting rings in an aft direction keeping said forward, middle and aft setting rings rotationally locked with respect to each other when said lock button is not being depressed and for permitting rotation between said forward, middle and aft rings when said lock button is depressed;

a first detent assembly biasedly disposed intermediate said aft setting ring and said stepped cup, which includes;

a first annularly shaped wave washer having an inwardly protruding key thereon for engaging a longitudinally positioned keyway in said stepped cup; and a first captured nylon ball fixedly disposed in said first wave washer;

a second detent assembly biasedly disposed intermediate said aft setting ring and said middle setting ring, which includes;

a second annularly shaped wave washer having an inwardly protruding key thereon for engaging said keyway in said stepped cup; and a second captured nylon ball fixedly disposed in said second wave washer;

a third detent assembly biasedly disposed intermediate said middle setting ring and said forward setting ring, which includes;

a third annularly shaped wave washer having an inwardly protruding key thereon for engaging said keyway in said stepped cup; and a third captured nylon ball fixedly disposed in said third wave washer.

6. A fuze encoder device as recited in claim 5 wherein said stop coil-pole means comprises:

a first electrical coil winding having a first pole piece magnetically fixedly coupled thereto, said first coil winding and first pole piece being rotatably supported in said rotor member and being in proximity of the magnetic field of said first magnet member of said aft setting ring when said encoding disc means rotates with respect to said indexing ring means, said first electrical coil winding being electrically connected to said electronic counting means;

a second electrical coil winding having a second pole piece magnetically fixedly coupled thereto, said second coil winding and second pole piece being rotatably supported on said rotor member and being in the proximity of the magnetic field of said second magnet member of said middle setting ring, said second electrical coil winding being electrically connected to said electronic counting means;

a third electrical coil winding having a third pole piece magnetically fixably coupled thereto, said third coil winding and third pole piece being rotatably supported on said rotor member and being in the proximity of the magnetic field of said third magnet member of said forward setting ring, said third electrical coil winding being electrically connected to said electronic counting means.

7. A fuze encoder device as recited in claim 6 wherein said electronic counting means comprises:

a setback generator operatively positioned in the rear end of said intrusion section of said shell and being initiated upon shell launch;

an oscillator electrically coupled to the output of said setback generator;

a first "And" gate having a first input terminal electrically coupled to the output of said magnetic encoding sensor, a second input terminal electrically connected to the output of said first electrical coil winding;

a first ten bit counter having an input electrically coupled to the output of said oscillator and said first "And" gate;

a second "And" gate having a first input terminal electrically coupled to the output of said magnetic encoding sensor, a second input terminal electrically connected to the output of said second electrical coil winding;

a second ten bit counter having an input electrically coupled to the output of said first ten bit counter and said second "And" gate;

a third "And" gate having a first input terminal electrically coupled to the output of said magnetic encoding sensor, in parallel with the electrical connection to the first input terminals of said first and second "And" gates, a second input terminal electrically connected to the output of said second ten bit counter and said second "And" gate; and a twenty bit counter having an input terminal electrically coupled to the output of said second ten bit counter and said third "And" gate, said twenty bit counter generating an output fuzing signal when said first and second ten bit counter and said twenty bit counter have been filled by the combination of pulses generated by said encoding disc member, as regulated by said first, second and third "And" gates, and said oscillator.

* * * * *